US005224788A

United States Patent [19]

Freed

[11] Patent Number: 5,224,788

[45] Date of Patent: Jul. 6, 1993

[54] DIRECT ACCESS MODULAR BINDER

[76] Inventor: Anna B. Freed, 185 E. 85th St., Suite 2-L, New York, N.Y. 10028

[21] Appl. No.: 917,332

[22] Filed: Jul. 23, 1992

[51] Int. Cl.[5] ..... B42F 3/12

[52] U.S. Cl. ..... 402/58; 402/53; 402/54; 402/59; 402/80 P; 403/299; 403/342; 403/343; 411/383; 411/389

[58] Field of Search ..... 402/46, 48, 49, 50, 402/51, 53, 54, 58, 59, 80 P; 403/118, 299, 342, 343; 411/383, 388, 389

[56] References Cited

U.S. PATENT DOCUMENTS

| | | | |
|---|---|---|---|
| 708,102 | 9/1902 | Waldo, Jr. . | |
| 722,061 | 3/1903 | Waldo, Jr. . | |
| 753,216 | 2/1904 | Hulquist . | |
| 755,008 | 3/1904 | Hulquist | 402/53 |
| 788,488 | 4/1905 | Miller | 402/58 |
| 848,671 | 4/1907 | Miller | 402/54 |
| 852,139 | 4/1907 | Revere | 402/53 |
| 947,975 | 2/1910 | McComb | 402/58 |
| 1,676,968 | 7/1928 | Stone | 402/58 |
| 2,099,472 | 11/1937 | Emery | 402/58 X |
| 2,474,698 | 8/1944 | Segal . | |
| 3,582,224 | 12/1968 | Frank . | |
| 3,701,605 | 10/1972 | Morishima | 402/58 |
| 4,136,981 | 1/1979 | Stecklow . | |
| 4,607,970 | 8/1986 | Heusinkveld . | |
| 4,990,017 | 2/1991 | Rotherham . | |

FOREIGN PATENT DOCUMENTS

| | | | |
|---|---|---|---|
| 242627 | 10/1946 | Fed. Rep. of Germany . | |
| 2107125 | 2/1971 | Fed. Rep. of Germany . | |
| 1078083 | 11/1954 | France | 402/58 |
| 062867 | 1/1913 | Switzerland . | |
| 503816 | 6/1951 | Switzerland . | |
| 017209 | of 1912 | United Kingdom . | |
| 596660 | 1/1948 | United Kingdom | 402/59 |

*Primary Examiner*—Paul A. Bell
*Attorney, Agent, or Firm*—William T. Bullinger

[57] ABSTRACT

A Direct Access Modular Binder containing one or more posts. Each post is comprised of two or more interconnected independent locking modules. These locking modules can easily be inserted or removed to change the length of the post to efficiently accommodate varying amounts of paper. The modules additionally function to permit direct access for insertion/removal of pages or modules anywhere along the post. The modules in the post may contain a telescoping feature. The module(s) containing a telescoping feature are optimally positioned at the end(s) of the post and fixedly attached to the post holding strips. The strips, which hold the posts' ends, may be hingedly attached to the front and back covers. The telescoping feature permits the binder to be automatically compacted (when not in use), for efficient storage, and temporarily expanded (when in use), to provide space for the user to insert-/remove paper or modules. The modules which make up the post are easily locked and unlocked. When unlocked, the left post may function to retain the paper on one side and the user need concern him/herself with insertion/removal on the other side only. The various locking embodiments include screw modules, hook modules and a compression module. Two telescoping methods are disclosed either of which may be used with any of the locking modules. The modules of a binder are of one chosen locking embodiment and telescoping method. An optional spine may be attached which cooperates with the expansion of the binder, adds strength and permits labeling.

9 Claims, 6 Drawing Sheets

Fig. 1.
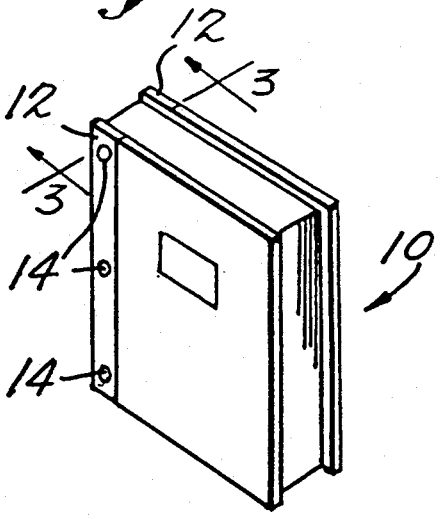
Fig. 2a.
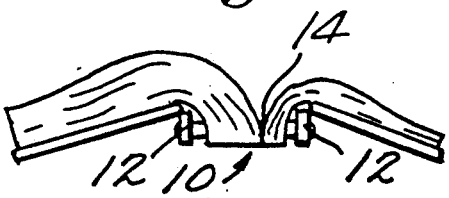
Fig. 2b.
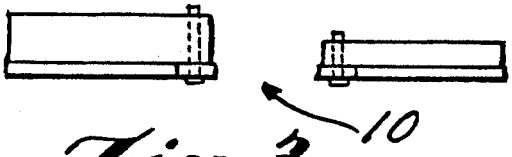
Fig. 3.
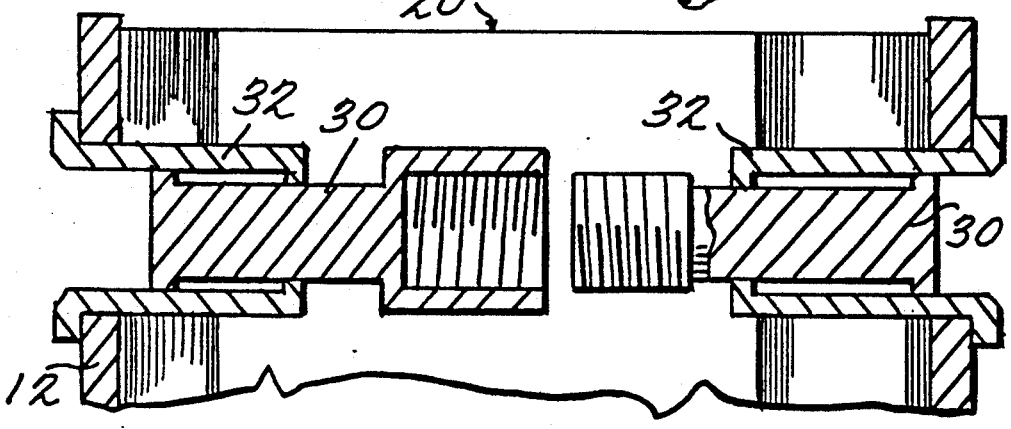
Fig. 5.
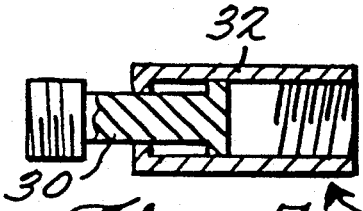
Fig. 4.
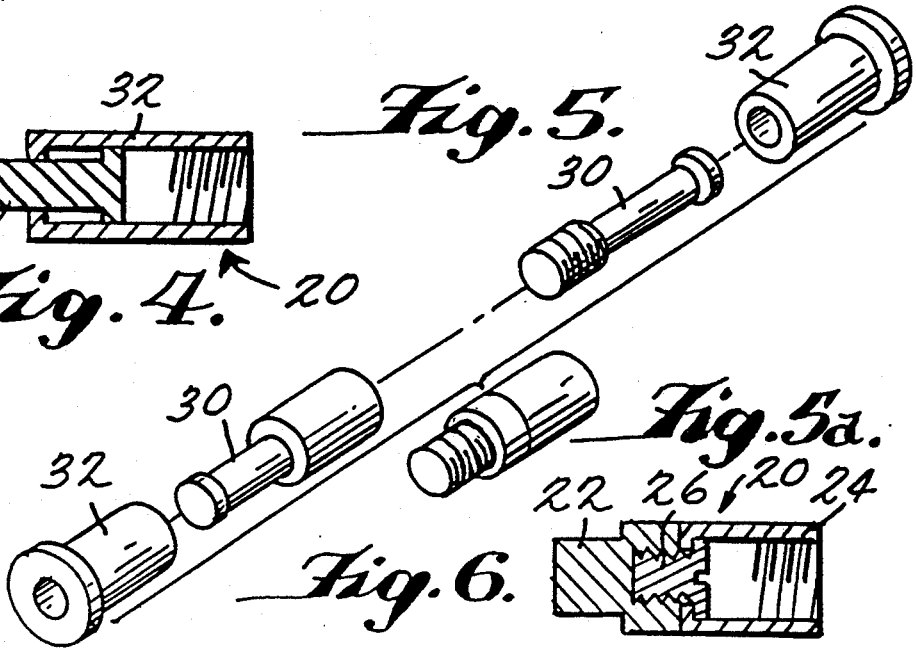
Fig. 5a.
Fig. 6.

Fig. 7.
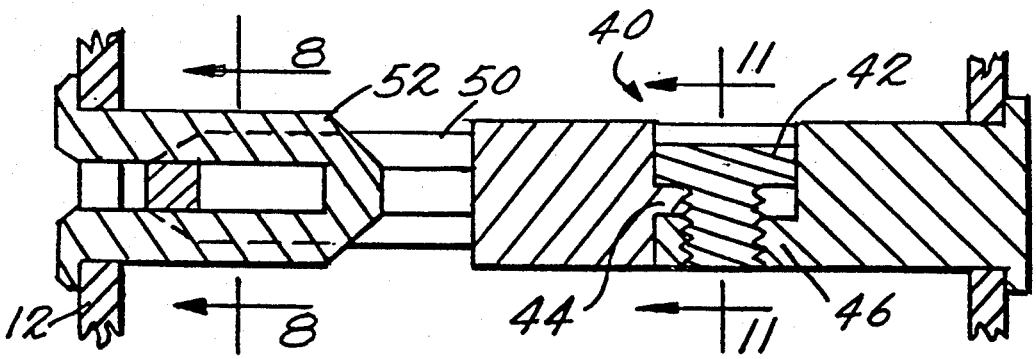
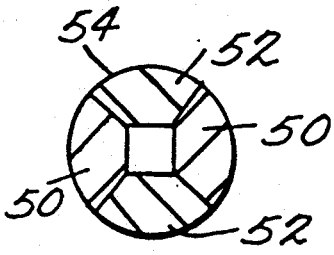
Fig. 8.
Fig. 9.
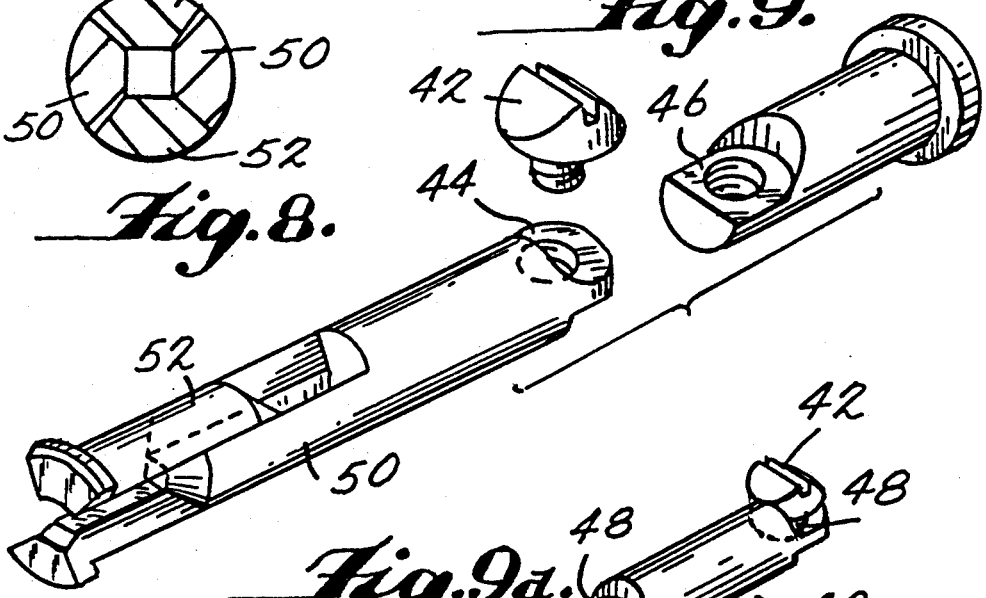
Fig. 9a.
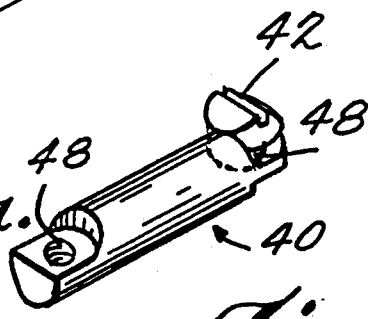
Fig. 10.
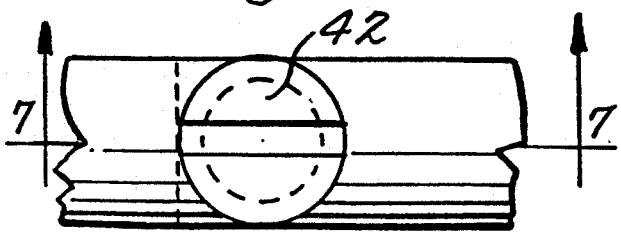
Fig. 11.
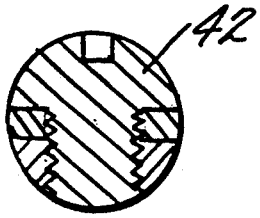

80
82
84
86
88
18

92
94
98
96

92
98
94
96

12
102
108
14
100
108
102
12

12
24
102
108
106
100
104
102
12
24
108
106
104

90
92
94

92
94

DIRECT ACCESS MODULAR BINDER

BACKGROUND OF THE INVENTION

1. Field of the Invention

The present invention relates to binders which hold perforated sheets of paper such as loose leaf paper, brochures, or fan-fold (i.e., continuous computer paper) etc.

2. Background Information

Vast quantities of hard copy information need to be retained, stored, updated, and accessed by businesses, individuals, and libraries etc., to insure record keeping compliance and maintenance for legal, business and other purposes. Until now, the most common means of maintaining this information has been the post or ring binder.

Access to random sections of a post binder is often required for both filing and retrieval of information. This access is a very arduous and exacting process requiring all the pages on a side of the post binder to be removed, held in alignment, and then replaced etc. When a ring binder is full, the user must either convert to a larger binder or purchase an additional one.

These difficulties and inconveniences require the user to choose between binder types, post or ring, each of which present potential problems. Post and ring binders each have their unique advantages and disadvantages. The present invention is a novel concept in binders and serves to eliminate the disadvantages associated with both "Post and Ring Binders" while simultaneously maintaining their advantages. Post binders are most useful for archiving when expandability is important and insertion/removal of paper is infrequent. Ring binders are most useful when insertion/removal of paper is frequent and expandability is of secondary importance. The present invention is the only known binder which is both expandable and permits direct access for insertion/removal of paper.

SUMMARY OF THE INVENTION

The present invention is a Direct Access Modular Binder. The binder has one or more posts each of which is composed of a series of interconnected locking modules. Each module is independent of the other modules in the post. If one module is opened by rotating, for example, the other modules are uneffected and do not rotate. The locking modules may or may not contain a telescoping feature. A synergy is created which further enhances the binders utility when one or two of the modules in the post contains a telescoping feature.

Two telescoping methods are disclosed. The rotatable method (FIGS. 2-5) and the non-rotatable/constant-circumference method (FIGS. 7-9). Modules with the telescoping feature would optimally be attached to the post holding strips but could be positioned anywhere within the post. The telescoping feature serves two functions; 1) to temporarily expand the binder to facilitate use and 2) to contract the binder for efficient storage.

The telescoping feature expands the binder by automatically sliding out when the user pulls the binder open. This provides space for the user to insert/remove paper and/or modules.

Either of the two telescoping methods may be contained within any of the five disclosed locking modules. If the modules comprising the post are screw lock modules, then the telescoping feature could be inserted in the screw lock module and would create a Direct Access Modular "SCREW LOCK" Binder as if FIG. 3.

One of the two telescoping methods disclosed may prove easier to assemble or manufacture, may be stronger, more durable, reliable, or may function better within a desired locking module.

Five locking modules are disclosed. The screw module (FIGS. 3-6), the perpendicular screw module (FIGS. 7-11), the hook module with screw barrel (FIGS. 12-15), the hook module with spring barrel (FIGS. 16-19), and the compression module (FIGS. 20-22). The perpendicular screw module can be unlocked by a coin which is inserted into a groove and turning. The screw module can be unlocked by turning the barrel until it opens. The hook modules can be unlocked by sliding (or unscrewing) the barrel until the hook is uncovered and then simply unhooking the hook. The compression module can be unlocked by compressing the sides of the module prior to pulling apart. Each of these locking embodiments is of simple construction, reliable, familiar to the user, and take only seconds to lock or unlock.

A module containing the telescoping feature is optimally positioned at either or both ends of the post and held by the post holding strips. This feature functions to allow the user to contract the binder for efficient storage and expand the binder for efficient use. For example, when the user closes the binder he/she would push the post holding strips together to contract the binder for efficient storage and when the user opens the binder, he/she would pull the post holding strips apart to expand the binder and thereby create space for the user to insert/remove paper and/or modules.

The advantage of the screw module is its simplicity. An advantage of the perpendicular screw module is that when unlocked, one side of the post is larger in diameter than the hole in the paper and therefore serves to retain the paper while the user inserts/removes paper from the other side. Another advantage of the perpendicular screw module is its constant circumference which allows paper to slide easily over the modules. An advantage of the compression module is that it is made of only one part.

The modules are independent of each other. This independence in conjunction with the telescoping feature, (neither of which is found in prior art), permits direct access to any part of the binder.

Of the five modules disclosed, certain modules may prove more durable, reliable, easier to assemble, inexpensive to manufacture etc. Based on the disclosure of the present invention, additional locking modules may be created by those skilled in the art and are intended to be included within the scope of this invention.

BACKGROUND ART

Two recent expandable binders have been disclosed by U.S. Pat. Nos. 4,990,017 to Rotherham and 4,136,981 to Stecklow. These recently invented binders do not approach the comprehensive utility made possible by the novel concepts incorporated into the Direct Access Modular Binder of the present invention. Neither of these binders is expandable and both have disadvantages associated with loose leaf binders.

The major advantage of the ring binder is direct access (the user can insert/remove pages anywhere within the binder directly). An additional advantage is it's spine, which is useful for labeling, protection and additional strength. The major advantage of the post binder is that it is expandable.

The major disadvantage of the ring binder is that it can only accommodate a maximum number of pieces of paper. Six additional disadvantages are 1) pages often get stuck and shredded near the ring mechanism of the front and back cover, 2) the pages don't lie flat, 3) the binder requires maximum storage space whether it contains only a few pages or is full and extra space is require for the rings, 4) the closed rings often do not align properly causing the pages to get stuck as they are turned, 5) large ring binders often require excessive strength to open or close, and 6) storage is inefficient and cumbersome due to the triangular external shape of the ring binders.

The major disadvantage of the expandable post binder is that insertion/removal of paper is a tedious, time consuming, and an exacting task requiring five distinct steps. The user must 1) undo each of the posts at one end of the binder, 2) remove all the pages up to the required spot (while carefully maintaining the alignment of the perforations in the removed pages as well as the order of the pages removed), 3) insert/remove the required pages, 4) carefully replace all the pages "held in alignment" onto the post, and 5) finally reconnect each of the posts. An additional disadvantage is that it does not contain a spine.

All known related art binders are either ring binders or post binders which have the respective advantages and disadvantages described above. The Direct Access Modular Binder is the only known binder which overcomes the deficiencies of the prior art while maintaining the benefits of both the post and ring binders described above.

OBJECTIVES

A major objective is to create an expandable and contractible binder that is durable, reliable, easy to use, simple to understand, easy to assemble, and inexpensive to manufacture while maintaining the benefits of both the ring and post binder and eliminating their inherent deficiencies.

An objective is to create a binder which easily allows the user to directly insert/remove paper anywhere within the stack.

An objective is to create a single binder which can readily accommodate varying amounts of paper from very small to very large.

An objective is to store the binder and its contents as compactly and efficiently as possible, using only the space required by the paper stack.

An objective is to have only one side of the module open for insertion/removal of paper freeing the user to work with the other side only.

An additional objective is for the paper to easily slide over the modules without getting caught. This could be accomplished by a constant outer circumference as with the perpendicular screw lock module, the compression module, combined with the non-rotatable telescoping method. Or, in the other modules, it could also be accomplished by either angling the ends of the barrels so they present a smooth and continuous external surface or by modifying their shape. For example, elliptical modules may work better in some embodiments.

Other objects, features and characteristics of the present invention, as well as the methods of operation and functions of the related elements of structure, and the combination of parts and the economies of manufacture will become more apparent upon consideration of the following detailed description and the appended claims with reference to the accompanying drawings all of which form a part of this specification, wherein like reference numerals designate corresponding parts in the various figures.

BRIEF DESCRIPTION OF DRAWINGS

The invention will further be described with reference to the following drawings, in which:

FIG. 1 shows a perspective view of the Direct Access Modular Binder;

FIG. 2A shows a plane view of the Direct Access Modular Binder with no spine and post holding strips integral with front and back cover;

FIG. 2B shows a plane view of the Direct Access Modular Binder having no spine and with the posts unlocked and paper lying flat;

FIG. 3 is a view in detail of the portion indicated by the section lines 3—3 in FIG. 1 showing the screw modules with a telescoping feature at both ends;

FIG. 4 shows a cross section view of the screw module with a telescoping feature which could be inserted in the post of FIG. 3;

FIG. 5 shows an exploded perspective view of the assembly of the Direct Access Modular Binder showing two screw ends which telescope as in FIG. 3;

FIG. 5A shows a perspective view of a screw locking module without the telescoping feature, (with left side of barrel integral with screw and right side freely rotating), which would be inserted into the post of FIG. 5 for expansion;

FIG. 6 shows a cross section of FIG. 5A;

FIG. 7 shows a post with the left end containing a non-rotating telescoping feature within a perpendicular screw module and the right end containing a perpendicular screw module end without the telescoping feature;

FIG. 8 shows a cross section of the non-rotating telescoping feature with constant diameter indicated by section lines 8—8;

FIG. 9 shows an exploded perspective view of the perpendicular screw module unlocked and the non-rotating telescoping feature of FIG. 7;

FIG. 9A shows and exploded perspective view of a complete perpendicular screw module which would be inserted into FIG. 9 to expand the post;

FIG. 10 shows a plane view of the perpendicular screw module;

FIG. 11 is a view in detail of the portion indicated by the section lines 11—11 in FIG. 7, showing a cross-section of the perpendicular screw module;

DETAILED DESCRIPTION OF THE PRESENTLY PREFERRED EXEMPLARY EMBODIMENTS

Figures 12, 12A, 13, 14, 15:
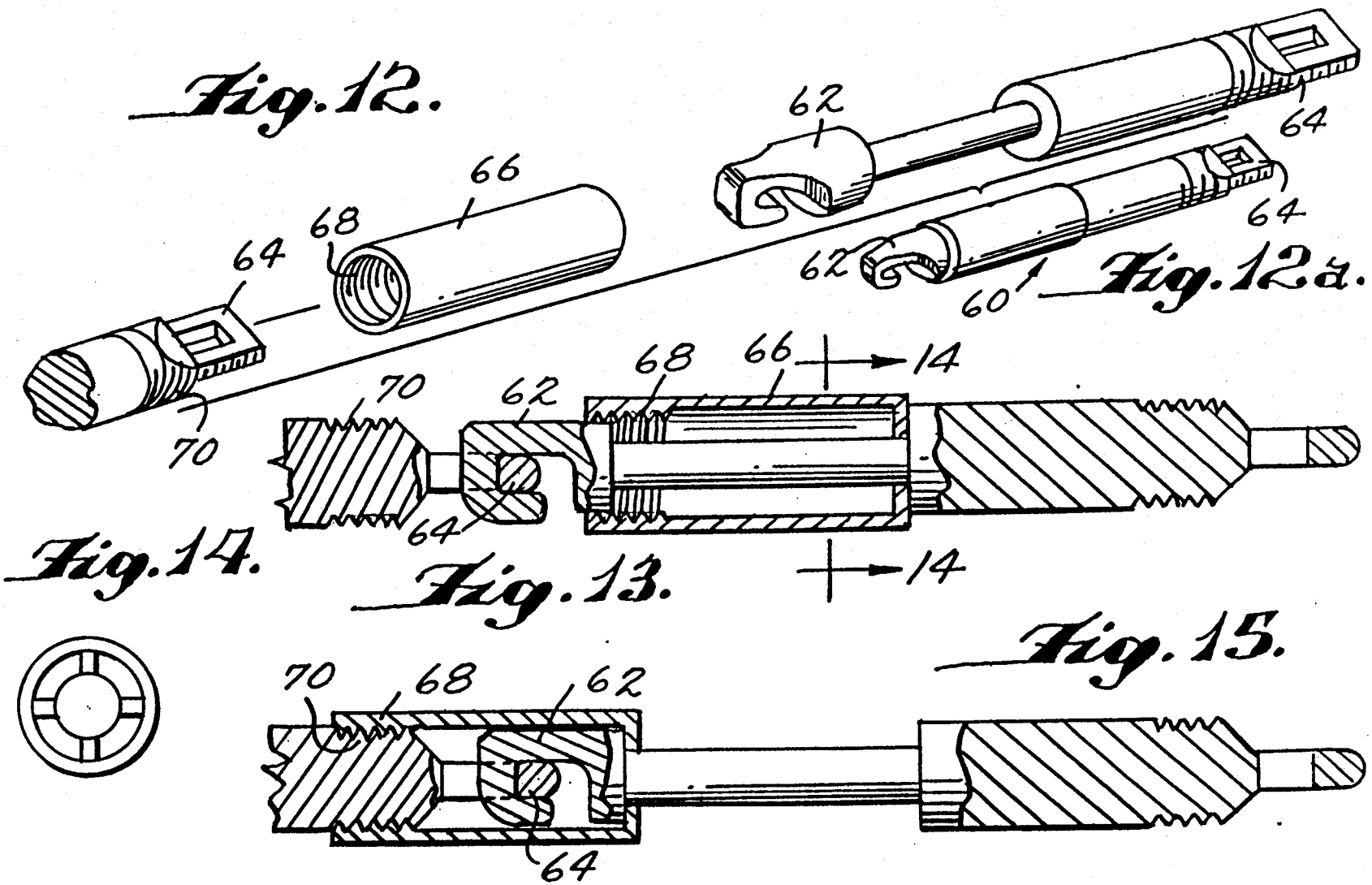
FIG. 12 shows an exploded perspective view of the assembly of the hook module with screw barrel.
FIG. 12A shows a perspective view of a complete hook module with screw barrel which would be inserted to expand the post of FIG. 12.
FIG. 13 shows a cross-section of the hook module of FIG. 14 with the screw barrel uncovering the hook lock.
FIG. 14 is a view in detail of the portion indicated by 14—14 in FIG. 13.
FIG. 15 shows a cross-section of the hook module of FIG. 12 with screw barrel covering the hook lock.

A direct access modular binder is shown by way of example, in FIG. 1. The assembly 10 includes two post holding strips 12 and three posts 14.

Each of the posts 14 is made of a plurality of modules. Each post 14 can be unlocked by disengaging adjacent modules. After the post has been unlocked, the binder can be opened as shown in FIG. 2B to allow the user to insert and remove paper from the binder. Also, the width of the binder can be modified by adding or removing modules to the post.

A screw module 20 is shown in the embodiment of FIGS. 3-6. The screw module, as shown in FIG. 6, includes a male threaded screw member 22 and a female threaded barrel member 24. The male threaded screw member 22 of the first screw module mates with a female threaded barrel member 24 of the second screw module. The screw module 20 includes a shoulder screw 26 which connects the male threaded screw member 22 to the female threaded barrel member 24. The shoulder screw 26 allows the male threaded screw member 22 and the female threaded barrel member 24 to rotate freely about their longitudinal axis with respect to one another. Of course, other devices such as a rivet, bolt, or the like, could be used in place of the shoulder screw 26.

As shown in FIGS. 3-5, the screw module can be equipped with a telescoping feature to allow the post to expand and contract. The telescoping feature includes a rod 30 which freely telescopes and rotates within a hollow cylindrical member 32. As shown in FIGS. 3-5, the telescoping feature is preferably contained within the modules at the outer ends of the posts 14 attached to the post holding strips 12. However, the telescoping feature may be contained within any module within the post 14.

A second independent locking embodiment is shown in FIGS. 7-11 that includes a perpendicular screw module 40. The perpendicular screw module includes a male screw member 42 that mates with a first female threaded member 44 and a second female threaded member 46.

Additional modules 40 are shown in FIG. 9A. Each additional module includes a female threaded bore 48 at each end of the module.

As shown in FIGS. 7-9, the perpendicular screw module embodiment is equipped with a second telescoping method. The second telescoping method includes a pair of U-shaped interlocking members 50, 52 which mesh together to form an outer cylindrical shape 54 of constant circumference. As with the first telescoping method, it is preferred to attach a module with a telescoping feature at the ends of the posts 14 to the post holding strips 12. Whether using the first or second telescoping method, it is preferred that only one end module per post 14 contain a telescoping feature.

In another embodiment, shown in FIGS. 12-15, the binder includes a hook module 60. The hook module includes a hook 62 that engages with a U-shaped notch 64. In the embodiment shown in FIGS. 12-15, the hook module includes a hollow cylindrical barrel 66 that has a female thread 68 at one end of the inner peripheral surface of the barrel 66. The end of the hook module that includes the U-shaped notch 64 includes male thread 70 that is sized to mate with female thread 68. The hook module 60 has the female thread 68 threaded to the male thread 70 in the extended position as shown in FIG. 15.

Figures 16, 16A, 17, 18, 19:
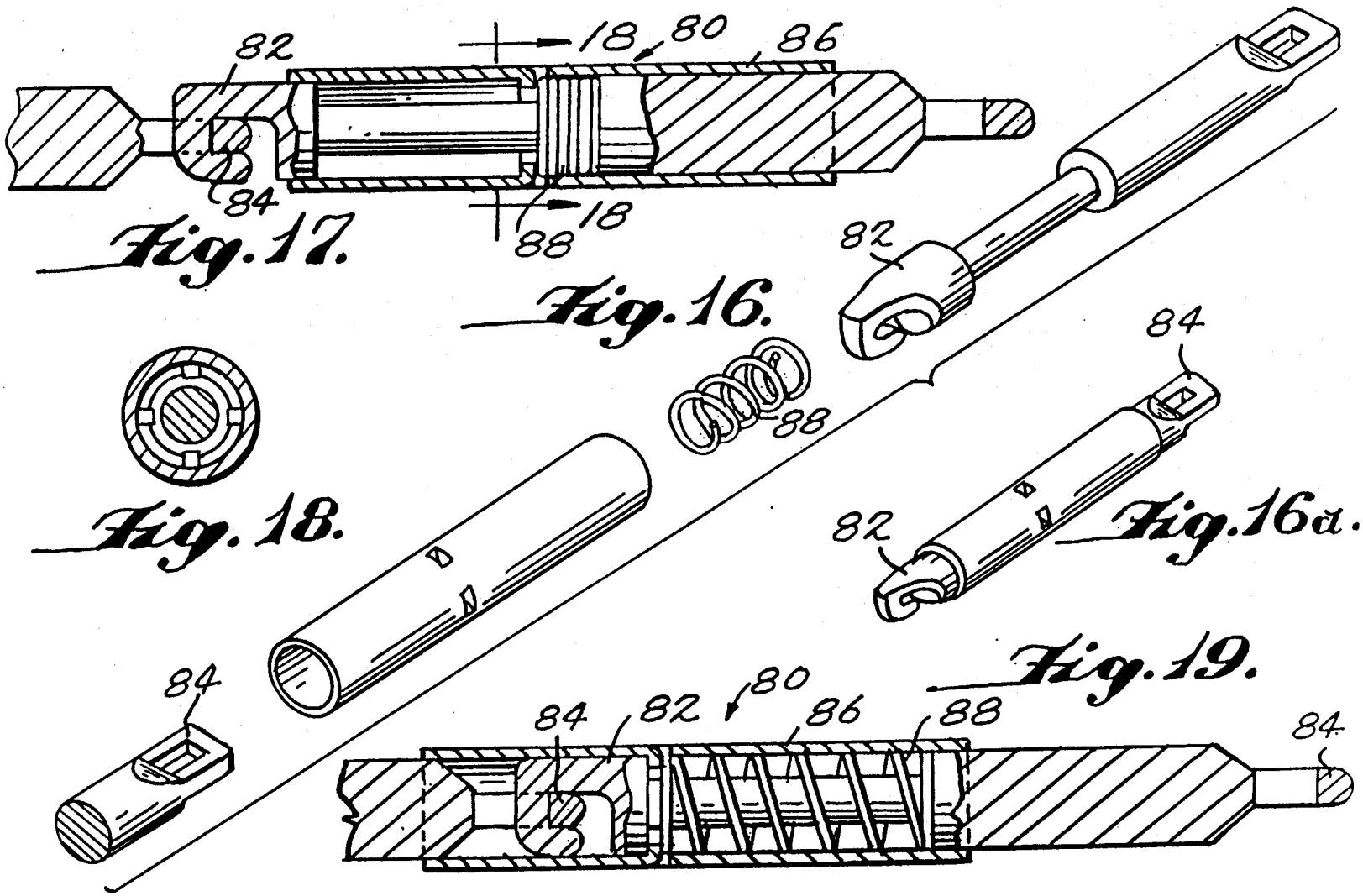
FIG. 16 shows an exploded perspective view of the assembly of the hook module with a spring barrel.
FIG. 16A shows a perspective view of a complete hook module with spring barrel which would be inserted to expand this post of FIG. 16.
FIG. 17 shows a cross-section of the hook module of FIG. 16 with spring barrel uncovering hook.
FIG. 18 is a view in detail of the portion indicated by 18—18 in FIG. 17.
FIG. 19 shows a cross-section of the hook module of FIG. 16 with spring barrel covering the hook.

Another embodiment of the hook module 80 is shown in FIGS. 17-19. This hook module differs from the hook module shown in FIGS. 12-15 in that the barrel 86 is spring loaded by a spring 88. The hook module 80 includes a hook module 82 and a U-shaped notch 84. The hook module is shown in its normally extended position in FIG. 19. To unlock the hook module, the user axially pulls on the barrel containing the hook 82 in a direction away from the U-shaped notch 84. This exposes the hook 82 outside of the barrel 86 as shown in FIG. 17. The user can then unhook the hook 82 from the U-shaped notch 84 to open the binder. The barrel 86 provides a smooth and continuous outer surface over the hook portion 82 of the hook module 80 to prevent paper from becoming entangled in the hook.

Figures 20, 20A, 21, 22, 23, 24:
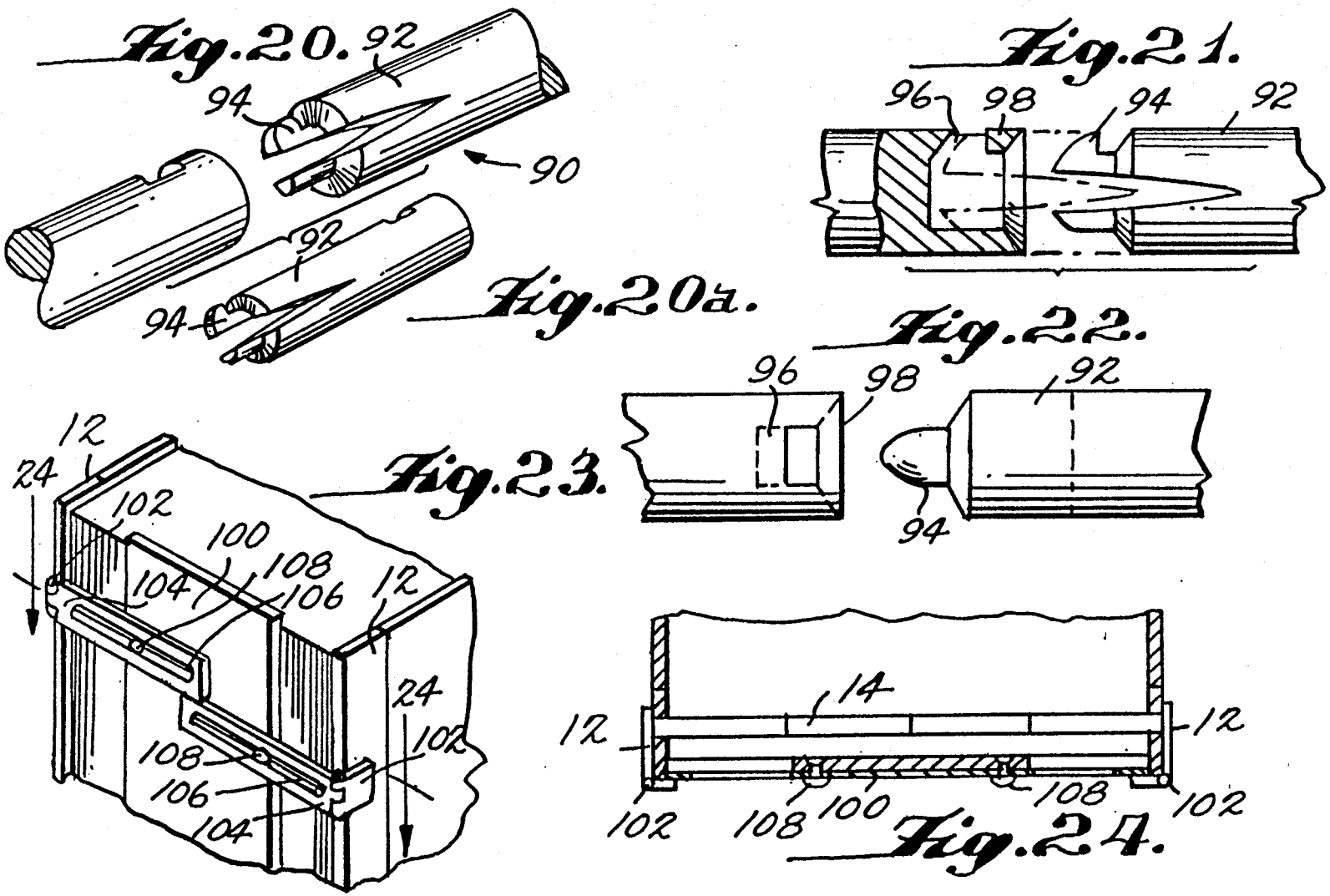
FIG. 20 shows an exploded perspective view of locking mechanism of the compression module.
FIG. 20A shows a complete compression module which would be inserted into FIG. 20 to expand the post of FIG. 20.
FIG. 21 shows a elevational view of the compression module of FIG. 20 in locked and unlocked position.
FIG. 22 shows a different plane view of the compression module of FIG. 20.
FIG. 23 shows a perspective view of the binder with a spine partially expanded for multiple modules.
FIG. 24 a view in detail of the portion indicated by section lines 24—24 in FIG. 23, showing the binder with multiple modules.

Another embodiment is shown in FIGS. 20-22. This embodiment includes a compression module 90 which can be squeezed or compressed together. To squeeze the compression module together, the user can take the first end 92 of the compression module 90 and squeeze the end together towards the axial center line. Then, the end 92 is pushed towards the open end 98 until the snapping portion 94 reaches opening 96. At this point, the user can release the pressure on the end 92 and allow the compression module to snap apart. To unlock the compression module 90, the user again will simply reverse the procedure described above by squeezing on the end 92 and retract the end 94 from the opening 98.

A spine 100 is shown in FIGS. 23 and 24. The spine 100 can be attached to the post holding strips 12 via hinges 102. Brackets 104 attach the spine 100 to the post holding strips 12. The brackets 104 each have a longitudinal slot 106 that receives a rivet 108 which is fixedly attached to the spine 100. This structure allows the spine to be expanded along with the posts. The post shown in FIG. 24 has four modules.

Figure 25:
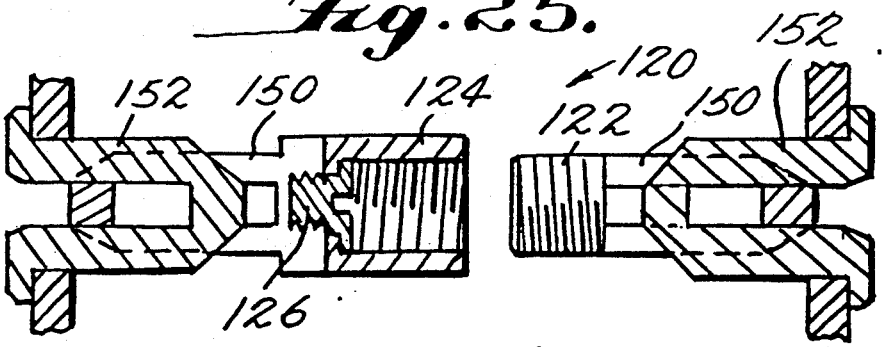
FIG. 25 is a view in detail corresponding to FIG. 3 except for having the non-rotating telescoping feature.
Figure 26:
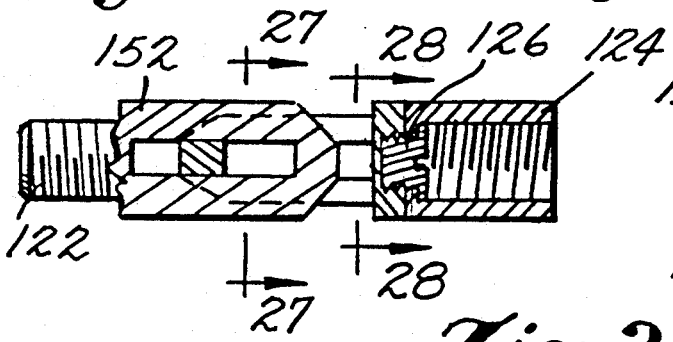
FIG. 26 shows a cross-sectional view of the screw module with a non-rotating telescoping feature which could be inserted in the post of FIG. 25.
Figure 27:
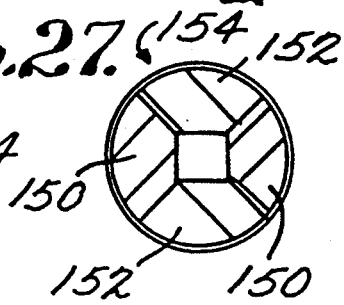
FIG. 27 shows a cross-sectional view of the screw module of FIG. 26.
Figure 28:
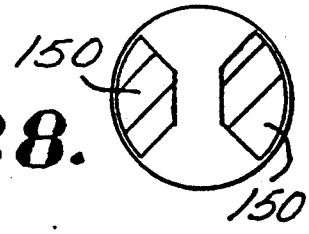
FIG. 28 shows a cross-sectional view of the screw module of FIG. 26.
Figure 29:
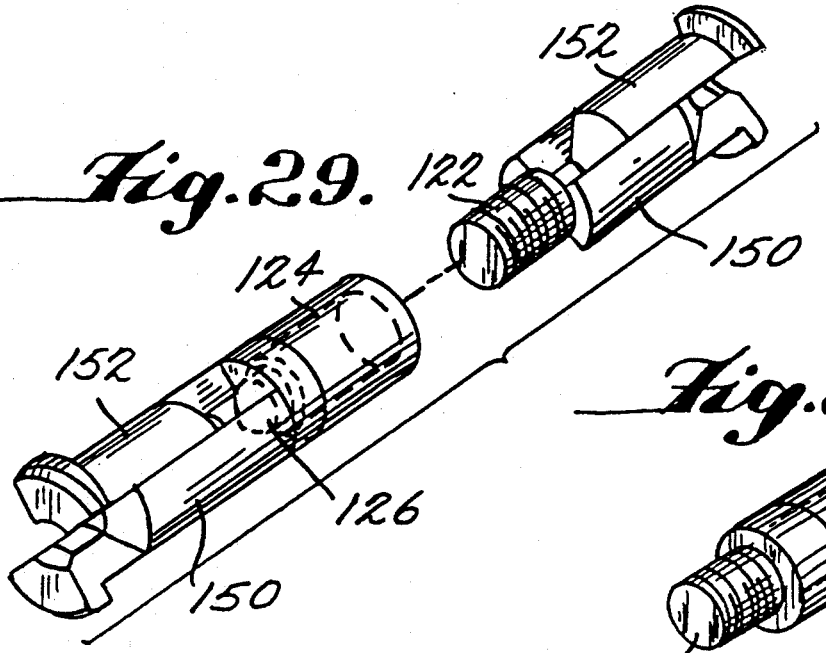
FIG. 29 shows an exploded perspective view of the assembly of the direct access modular binder showing two screw ends which telescope as in FIG. 25.
Figure 29A:
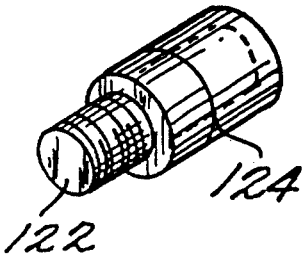
FIG. 29A shows a perspective view of a screw locking module without the telescoping feature which would be inserted into the post of FIG. 29 for expansion.

FIG. 25 is a view in detail corresponding to FIG. 3 except for having the non-rotating telescoping feature. FIG. 26 shows a cross-sectional view of the screw module with a non-rotating telescoping feature which could be inserted in the post of FIG. 25. FIG. 27 shows a cross-sectional view of the screw module of FIG. 26. FIG. 28 shows a cross-sectional view of the screw module of FIG. 26. FIG. 29 shows an exploded perspective view of the assembly of the direct access modular binder showing two screw ends which telescope as in FIG. 25. FIG. 29A shows a perspective view of a screw locking module without the telescoping feature which would be inserted into the post of FIG. 29 for expansion.

The binder of the present invention allows the user to have direct access to insert and remove pages anywhere within the binder. The present invention also allows the posts to be expandable while still having a spine.

Although this invention has been described generally in terms of what is presently considered to be the most practical and preferred embodiments, it is to be understood that the invention is not limited to the disclosed embodiments. For example, differently constructed independent locking modules as well as different telescoping methods could be created, based on the teachings of the present invention, by those skilled in the art. This invention is intended to cover various modifications and equivalent arrangements included within the spirit and scope of the appended claims.

What is claimed is:

1. A direct access binder comprising:

(a) two post holding strips;

(b) at least one post, said at least one post having ends which are held by said two post holding strips, said ends including one male member and one female member;

(c) at least one independent interior module comprising each of said at least one post, said at least one independent interior module further comprising means for enabling said binder to be modified to be desired width, said at least one independent interior module further comprising a second male member and a second female member;

(d) a locking means for engaging and disengaging any one of said at least one independent interior module from the remainder of said at least one independent interior module and said ends; and (e) a rotation means for rotatably coupling said second male member and said second female member such that said second male member rotates freely with respect to said second female member.

2. A direct access binder as in claim 1, further comprising a spine hingedly attached to said two post holding strips, said spine cooperating with said at lest one post to enable said binder to be modified to said desired width.

3. A direct access binder as in claim 1 further including a telescoping means for expanding and contracting each of said at least one post, said telescoping means included within any of said at least one independent interior module and said ends.

4. A direct access binder as in claim 3 wherein said telescoping means includes a rod which freely telescopes and rotates within a hollow cylindrical member.

5. A direct access binder as in claim 3 wherein said telescoping means includes a pair of interlocking members, said pair of interlocking members mesh to create a constant outer circumference.

6. An independent interior module or use with a direct access binder comprising:

(a) a male threaded member and a female threaded member; and (b) a rotation means for rotatably coupling said male threaded member and said female threaded member such that said male threaded member rotates freely with respect to said female threaded member.

7. An independent interior module as in claim 6 further including a telescoping means for expanding and contracting said independent interior module.

8. An independent interior module as in claim 7 wherein said telescoping means includes a rod which freely telescopes and rotates within a hollow cylindrical member.

9. An independent interior module as in claim 7 wherein said telescoping means includes a pair of interlocking members, said pair of interlocking members mesh to create a constant outer circumference.

* * * * *